US009690310B2

(12) United States Patent
Shin

(10) Patent No.: US 9,690,310 B2
(45) Date of Patent: Jun. 27, 2017

(54) INTERNAL VOLTAGE GENERATOR OF SEMICONDUCTOR DEVICE AND METHOD FOR DRIVING THE SAME

(71) Applicant: SK hynix Inc., Gyeonggi-do (KR)

(72) Inventor: Yoon-Jae Shin, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 14/996,372

(22) Filed: Jan. 15, 2016

(65) Prior Publication Data

US 2017/0045900 A1 Feb. 16, 2017

(30) Foreign Application Priority Data

Aug. 12, 2015 (KR) ..... 10-2015-0113771

(51) Int. Cl.
*G05F 1/56* (2006.01)
*G05F 1/563* (2006.01)
*G05F 1/46* (2006.01)

(52) U.S. Cl.
CPC ..... *G05F 1/563* (2013.01); *G05F 1/465* (2013.01); *G05F 1/56* (2013.01)

(58) Field of Classification Search
CPC ..... G05F 1/56; G05F 1/563
See application file for complete search history.

(56) References Cited

U.S. PATENT DOCUMENTS 5,504,452 A * 4/1996 Takenaka ..... G11C 5/147 327/540
5,587,674 A * 12/1996 Danstrom ..... H03K 3/02337 327/206
6,025,707 A * 2/2000 Joo ..... G05F 1/465 323/283
6,157,176 A * 12/2000 Pulvirenti ..... G05F 1/565 323/266
6,281,744 B1 * 8/2001 Kang ..... G05F 1/465 327/541
6,515,461 B2 * 2/2003 Akiyama ..... G05F 1/465 323/313
6,522,111 B2 * 2/2003 Zadeh ..... G05F 1/575 323/277
6,586,986 B2 * 7/2003 Kang ..... G05F 1/465 326/87
6,677,737 B2 * 1/2004 Hamon ..... H03K 17/122 323/275
7,821,327 B2 * 10/2010 Parameswaran H03K 19/018528 326/83

(Continued)

FOREIGN PATENT DOCUMENTS

KR 1020140029706 3/2014

*Primary Examiner* — Thomas J Hiltunen
(74) *Attorney, Agent, or Firm* — IP & T Group LLP

(57) ABSTRACT

An internal voltage generator includes: a comparison block suitable for comparing an internal voltage with a reference voltage and generating a first comparison signal having an analog level corresponding to a comparison result a first driving block suitable for driving an output terminal of the internal voltage with a source voltage in response to the first comparison signal; a logic block suitable for generating a second comparison signal having a logic level based on the first comparison signal; and a second driving block suitable for driving the output terminal of the internal voltage with the source voltage based on the second comparison signal.

7 Claims, 3 Drawing Sheets

(56) References Cited

U.S. PATENT DOCUMENTS

| | | | | |
|---|---|---|---|---|
| 7,928,798 | B2 * | 4/2011 | Lee | G11C 11/4074 327/541 |
| 7,982,448 | B1 * | 7/2011 | Prasad | G05F 1/56 323/311 |
| 8,120,971 | B2 * | 2/2012 | Oh | G11C 5/146 323/313 |
| 8,482,266 | B2 * | 7/2013 | Yu | G05F 1/575 323/280 |
| 9,389,620 | B2 * | 7/2016 | Banag | G05F 1/46 |
| 2008/0218137 | A1 * | 9/2008 | Okuyama | G05F 1/575 323/273 |
| 2009/0066306 | A1 * | 3/2009 | Noda | G05F 1/575 323/282 |
| 2015/0171731 | A1 * | 6/2015 | Tomioka | H02M 1/088 307/52 |
| 2016/0252919 | A1 * | 9/2016 | Tanaka | G05F 1/56 |

* cited by examiner

INTERNAL VOLTAGE GENERATOR OF SEMICONDUCTOR DEVICE AND METHOD FOR DRIVING THE SAME

CROSS-REFERENCE TO RELATED APPLICATIONS

The present application claims priority of Korean Patent Application No. 10-2015-0113771, filed on Aug. 12, 2015, which is incorporated herein by reference in its entirety.

BACKGROUND

1. Field

Exemplary embodiments of the present invention relate to semiconductor design technology and, more particularly, to an internal voltage generator of a semiconductor device.

2. Description of the Related Art

Generally, semiconductor devices generate an internal voltages required for internal operations based on a power source voltage VDD and a ground voltage VSS supplied from an external source. For example a memory device such as a Dynamic Random Access Memory (DRAM) generates a core voltage VCORE supplied to a memory core region, a boosted voltage VPP used for driving word lines, and a reduced voltage VBB supplied as a back bias voltage of an NMOS transistor in a core region. Hereinafter, an example of a semiconductor device generating a core voltage VCORE is described.

Specifically, FIG. 1 is a block diagram illustrating a conventional internal voltage generator 100 of a semiconductor device.

Referring to FIG. 1, the conventional internal voltage generator 100 may include a comparison block 110 a driving block 120, and a feedback block 130.

The comparison block 110 typically compares a feedback voltage VFDB with a reference voltage VREFC and generates an analog comparison signal VDIF according to the comparison result. The driving block 120 generates a core voltage VCORE in response to the comparison signal VDIF.

The feedback block 130 typically generates the feedback voltage VFDB that has a voltage level corresponding to the core voltage VCORE.

FIG. 2 is a detailed diagram of the internal voltage generator 100 shown in FIG. 1.

Referring to FIG. 2, the comparison block 110 includes a differential amplifier including a first PMOS transistor MXP0 a second PMOS transistor MXP1 a first NMOS transistor MXN0 a second NMOS transistor MXN1, and a third NMOS transistor MXN2. The first PMOS transistor MXP0 has a source coupled to a power source voltage VDD terminal, a drain coupled to a first output terminal DRV and a gate coupled to a second output terminal MIR. The second PMOS transistor MXP1 has a drain and a gate that are coupled to the second output terminal MIR and a source coupled to the power source voltage VDD terminal, The first NMOS transistor MXN0 has a source coupled to a common coupling terminal CC, a drain coupled to the first output terminal DRV and a gate receiving the reference voltage VREFC. The second NMOS transistor MXN1 has a source coupled to the common coupling terminal CC, a drain coupled to the second output terminal MIR and a gate receiving the feedback voltage VFDB. The third NMOS transistor MXN2 has a source coupled to a ground voltage VSS terminal, a drain coupled to the common coupling terminal CC and a gate receiving a bias voltage VBIAS.

The comparison signal VDIF is outputted through the first output terminal DRV. The bias voltage VBIAS is inputted as an enable signal for enabling the comparison block 110.

The driving block 120 typically drives a core voltage VCORE terminal with a power source voltage VDD in response to the comparison signal VINE. For example, the driving block 120 includes a third PMOS transistor MXP2. The third PMOS transistor MXP2 has a source coupled to the power source voltage VDD terminal, a drain coupled to the core voltage VCORE terminal and a gate receiving the comparison signal VDIF.

The feedback block 130 typically divides the core voltage VCORE at a preset division ratio to generate the feedback voltage VFDB. For example, the feedback block 130 includes a fourth NMOS transistor MXN3 and a fifth NMOS transistor MXN4. The fourth NMOS transistor MXN3 has a drain and a gate that are coupled to the core voltage VCORE terminal and a source coupled to a feedback voltage terminal FDB, The fifth NMOS transistor MXN4 has a drain and a gate that are coupled to the feedback voltage terminal FDB and a source coupled to the ground voltage VSS terminal.

A case where the core voltage VCORE is lowered is now described. For example, the core voltage VCORE may be lowered below a target level of the core voltage VCORE when a load current occurs.

The comparison block 110 compares the feedback voltage VFDB with the reference voltage VREFC and generates the comparison signal VDIF corresponding to the comparison result. When the feedback voltage VFDB is lower than the reference voltage VREFC, the comparison block 110 generates the comparison signal VDIF whose voltage level may be lowered to correspond to a voltage difference between the feedback voltage VFDB and the reference voltage VREFC.

For example, when the core voltage VCORE is lowered below the target level of the core voltage VCORE, the feedback voltage VFDB may become lower than the reference voltage VREFC and thus a voltage level of the first output terminal DRV may become lower as well. Therefore, the voltage level of the comparison signal VDIF may be lowered to correspond to the voltage level of the first output terminal DRV.

The driving block 120 turns on and drive the core voltage VCORE terminal with the power source voltage VDD in response to the comparison signal VDIF. Therefore, the core voltage VCORE increases.

A case where the core voltage VCORE is increased is now described. For example, the core voltage VCORE may keep the target level of the core voltage VCORE or increase above the target level of the core voltage VCORE by the driving block 120.

The comparison block 110 typically compares the reference voltage VREFC with the feedback voltage VFDB and generates the comparison signal VDIF corresponding to the comparison result. When the feedback voltage VFDB is higher than the reference voltage VREFC, the comparison block 110 generates the comparison signal VDIF whose voltage level increases corresponding to the voltage difference between the feedback voltage VFDB and the reference voltage VREFC.

For example, when the core voltage VCORE increases above the target level of the core voltage VCORE, the feedback voltage VFDB may also increase above the reference voltage VREFC and thus, the voltage level of the first output terminal DRV may be increased. Therefore, the voltage level of the comparison signal VDIF may be increased corresponding to the voltage level of the first output terminal DRV.

The driving block 120 may be turned off in response to the comparison signal VDIF causing the core voltage VCORE to be lowered.

Hence, a conventional internal voltage generator 100, may maintain the core voltage VCORE at a target level. However, some issues may occur.

For example, the comparison signal VDIF is an analog signal that varies corresponding to the voltage level of the first output terminal DRV. The driving block 120 operates in response to the comparison signal VDIF that is the analog signal. Therefore, in a conventional internal voltage generator 100 a fluctuation of the core voltage VCORE may occur and current consumption increase.

Further, generally, as the internal voltage generator 100 is formed in a regulator type, a response time required for sensing and compensating for the fluctuation of the core voltage VCORE may be slow.

SUMMARY

Various embodiments of the present invention are directed to an internal voltage generator that may generate an internal voltage based on a comparison signal having an analog level and a comparison signal having a logic level.

Further, various embodiments of the present invention are directed to an internal voltage generator that may generate an internal voltage based on a comparison signal having an analog level and a comparison signal having a logic level and provide a sink current path based on a digital signal related to the comparison signal having the logic level.

According to an embodiment of the present invention, an internal voltage generator may include: a comparison block suitable for comparing an internal voltage with a reference voltage and generating a first comparison signal having an analog level corresponding to a comparison result; a first driving block suitable for driving an output terminal of the internal voltage with a source voltage in response to the first comparison signal; a logic block suitable for generating a second comparison signal having a logic level based on the first comparison signal; and a second driving block suitable for driving the output terminal of the internal voltage with the source voltage based on the second comparison signal.

The logic block may generate the second comparison signal having a first logic level when a voltage level of the first comparison signal is lower than a logic threshold voltage.

The logic block may generate the second comparison signal having a second logic level when the voltage level of the first comparison signal is higher than the logic threshold voltage.

The first driving block may be selectively enabled based on the voltage level of the first comparison signal while the voltage level of the first comparison signal is higher than the logic threshold voltage and continuously enabled based on the voltage level of the first comparison signal while the voltage level of the first comparison signal is lower than the logic threshold voltage.

The second driving block may be disabled while the voltage level of the first comparison signal is higher than the logic threshold voltage and enabled while the voltage level of the first comparison signal is lower than the logic threshold voltage.

The logic block may include: a first inversion unit suitable for inverting the first comparison signal based on the logic threshold voltage to generate an inverted logic signal; and a second inversion unit suitable for inverting the inverted logic signal based on the logic threshold voltage to generate the second comparison signal.

According to another embodiment of the present invention, an internal voltage generator may include: a comparison block suitable for comparing an internal voltage that is fed back with a reference voltage and generating a first comparison signal having an analog level corresponding to a comparison result; a first driving block suitable for driving an output terminal of the internal voltage with a source voltage in response to the first comparison signal; a logic block suitable for generating a second comparison signal having a logic level based on the first comparison signal; a second driving block suitable for driving the output terminal of the internal voltage with the source voltage based on the second comparison signal; and an additional path providing block suitable for additionally providing the comparison block with a current source based on an inverted signal of the second comparison signal.

The logic block may generate the second comparison signal having a first logic level when a voltage level of the first comparison signal is lower than a logic threshold voltage.

The logic block may generate the second comparison signal having a second logic level when the voltage level of the first comparison signal is higher than the logic threshold voltage.

The first driving block may be selectively enabled based on the voltage level of the first comparison signal while the voltage level of the first comparison signal is higher than the logic threshold voltage and continuously enabled based on the voltage level of the first comparison signal while the voltage level of the first comparison signal is lower than the logic threshold voltage.

The second driving block may be disabled while the voltage level of the first comparison signal is higher than the logic threshold voltage and enabled while the voltage level of the first comparison signal is lower than the logic threshold voltage.

The logic block may include: a first inversion unit suitable for inverting the first comparison signal based on the logic threshold voltage and generating an inverted logic signal; and a second inversion unit suitable for inverting the inverted logic signal based on the logic threshold voltage and generating the second comparison signal.

The inverted signal of the second comparison signal may correspond to the inverted logic signal.

According to another embodiment of the present invention, a method for driving an internal voltage generator may include: generating a first comparison signal having an analog level based on an internal voltage; generating a second comparison signal having a logic level based on the a comparison of the first comparison signal with a logic threshold voltage; and compensating for the internal voltage based on the first comparison or second comparison signal depending upon the voltage level of the first comparison signal.

The compensating of the internal voltage may include: driving by the first driving block the internal voltage based on the first comparison signal during a first fluctuation section; and driving by the first driving block and the second driving block the internal voltage based on the first comparison signal and the second comparison signal during a second fluctuation section.

The first driving block may adaptively drive the internal voltage based on the voltage level of the first comparison signal.

The second driving block may drive the internal voltage in response to the second comparison signal.

A sink current path may be additionally provided to a comparison block for generating the first comparison signal during the second fluctuation section.

The second comparison signal may have a first logic level when the voltage level of the first comparison signal is lower than the logic threshold voltage.

The second comparison signal may have a second logic level when the voltage level of the first comparison signal is higher than the logic threshold voltage.

DETAILED DESCRIPTION

Exemplary embodiments of the present invention are described below in more detail with reference to the accompanying drawings. These embodiments are provided so that this disclosure is thorough and complete to those skilled in the art to which the invention pertains. It is noted that the described embodiments are mere examples of the invention and are not intended to limit the scope of the invention.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" "comprising," "includes" and/or "including" when used in this specification, indicate the presence of stated features, but do not preclude the presence or addition of one or more other features. As used herein, the term "and/or" indicates any and all combinations of one or more of the associated listed items.

In the described embodiments, a core voltage VCORE is described as an example of an internal voltage. It is noted that the invention is not limited in this way. For example, the invention may be employed with any other internal voltage.

Figure 1:
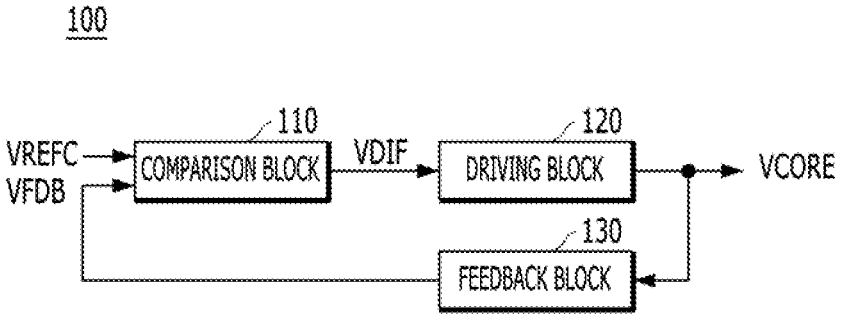
FIG. 1 (PRIOR ART)
FIG. 1 is a block diagram illustrating a conventional internal voltage generator.
Figure 2:
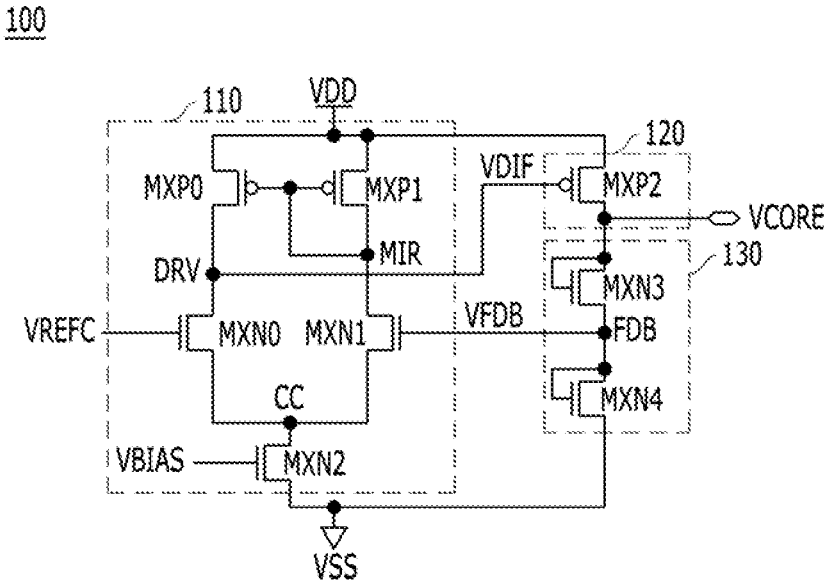
FIG. 2 (PRIOR ART)
FIG. 2 is a detailed diagram of the internal voltage generator shown in FIG. 1.
Figure 3:
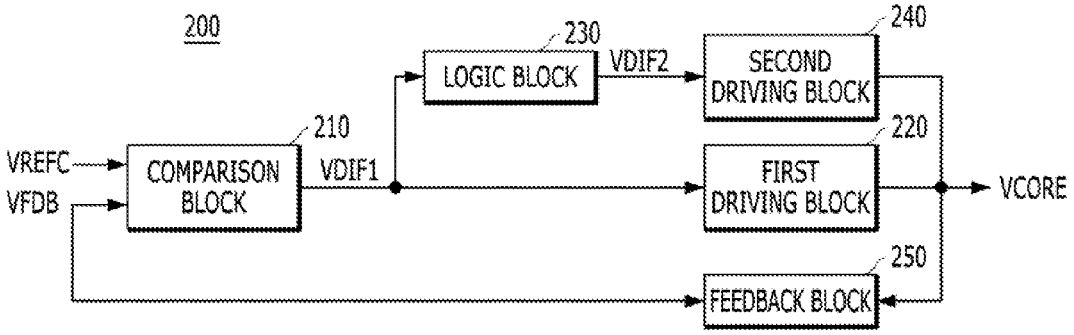
FIG. 3 is a block diagram illustrating an internal voltage generator, according to an embodiment of the present invention.

FIG. 3 is a block diagram illustrating an internal voltage generator, according to an embodiment of the present invention.

Referring to FIG. 3, the internal voltage generator 200 may include a comparison block 210, a first driving block 220, a logic block 230, a second driving block 240, and a feedback block 250.

The comparison block 210 may compare a reference voltage VREFC with a feedback voltage VFDB and generate a first comparison signal VDIF1 corresponding to the comparison result. The first comparison signal VDIF1 may have an analog level that varies corresponding to a voltage difference between the reference voltage VREFC and the feedback voltage VFDB.

The first driving block 220 may generate a core voltage VCORE in response to the first comparison signal VDIF1. For example, the first driving block 220 may be enabled when the feedback voltage VFDB is lower than the reference voltage VREFC. When the first driving block 220 is enabled, the first driving block 220 may adaptively drive the core voltage VCORE based on a voltage level of the first comparison signal VDIF1. The first driving block 220 may be disabled when the feedback voltage VFDB is higher than the reference voltage VREFC.

The logic block 230 may generate a second comparison signal VDIF2 in response to the first comparison signal VDIF1. The logic level of the second comparison signal VDIF2 may be determined according to the voltage level of the first comparison signal VDIF1 based on a logic threshold voltage.

The second driving block 240 may generate the core voltage VCORE in response to the second comparison signal VDIF2. For example, the second driving block 240 may be enabled when the voltage level of the first comparison signal VDIF1 is lower than the logic threshold voltage. When the second driving block 240 is enabled, the second driving block 240 may fully drive the core voltage VCORE in response to the second comparison signal VDIF2. The second driving block 240 may be disabled when the voltage level of the first comparison signal VDIF1 is higher than the logic threshold voltage.

The feedback block 250 may generate the feedback voltage VFDB corresponding to the core voltage VCORE. For example, the feedback voltage VFDB may be a voltage obtained by dividing the core voltage VCORE. It is noted, however, that the invention may not be limited in this way. For example, the feedback voltage may have any suitable relationship to the core voltage.

Figure 4:
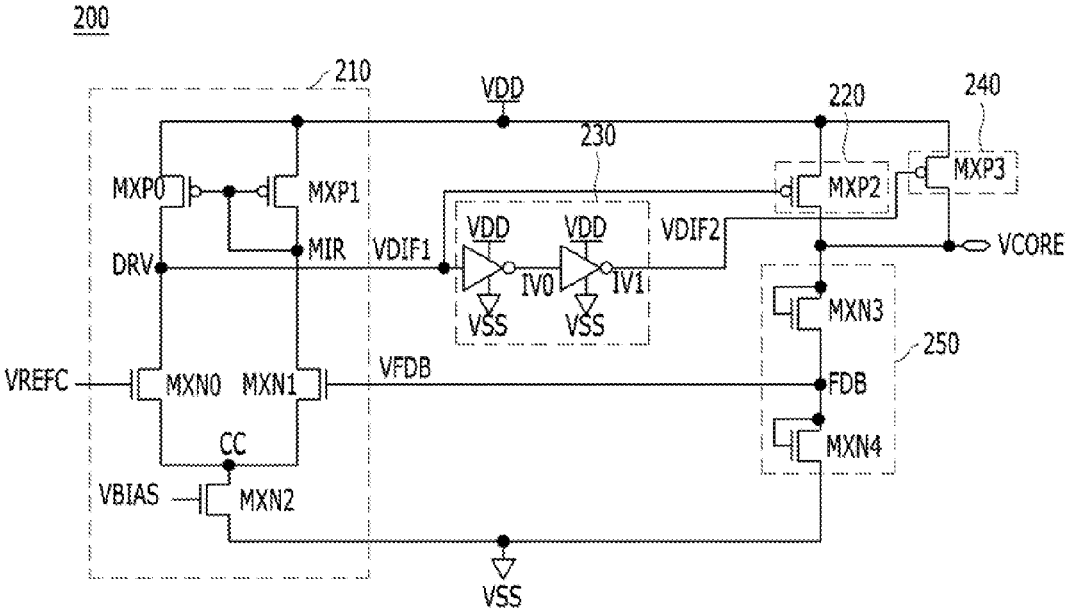
FIG. 4 is a circuit diagram of an internal voltage generator, according to an embodiment of the present invention.

FIG. 4 is a circuit diagram of an internal voltage generator 200 shown in FIG. 3, according to an embodiment of the invention.

Referring to FIG. 4, the comparison block 210 may include a differential amplifier. For example, the comparison block 210 may include a first PMOS transistor MXP0, a second PMOS transistor MXP1, a first NMOS transistor MXN0, a second NMOS transistor MXN1, and a third NMOS transistor MXN2. The first PMOS transistor MXP0 has a source coupled to a power source voltage VDD terminal, a drain coupled to a first output terminal DRV and a gate coupled to a second output terminal MIR. The second PMOS transistor MXP1 has a source coupled to the power source voltage VDD terminal, a drain coupled to the second output terminal MIR and a gate coupled to the second output terminal MIR. The first NMOS transistor MXN0 has a source coupled to a common coupling terminal CC a drain coupled to the first output terminal DRV and a gate receiving the reference voltage VREFC. The second NMOS transistor MXN1 has a source coupled to the common coupling terminal CC, a drain coupled to the second output terminal MIR and a gate receiving the feedback voltage VFDB. The third NMOS transistor MXN2 has a source coupled to a ground voltage VSS terminal, a drain coupled to the common coupling terminal CC and a gate receiving a bias voltage VBIAS.

The first comparison signal VDIF1 may be outputted through the first output terminal DRV. The bias voltage VBIAS may be inputted as an enable signal for enabling the comparison block 210.

The first driving block 220 may drive a core voltage VCORE terminal with a power source voltage VDD in response to the first comparison signal VDIF1. The first driving block 220 may be selectively enabled based on the voltage level of the first comparison signal VDIF1 while the voltage level of the first comparison signal VDIF1 is higher than the logic threshold voltage. The first driving block 220 may be continuously enabled based on the voltage level of the first comparison signal VDIF1 while the voltage level of the first comparison signal VDIF1 is lower than the logic threshold voltage. For example, the driving block 220 may include a third PMOS transistor MXP2. The third PMOS transistor MXP2 has a source coupled to the power source voltage VDD terminal, a drain coupled to the core voltage VCORE terminal and a gate receiving the first comparison signal VDIF1.

The logic block 230 may generate the second comparison signal VDIF2 having a first logic level when the voltage level of the first comparison signal VDIF1 is lower than the logic threshold voltage. The logic block 230 may generate the second comparison signal VDIF2 having a second logic level when the voltage level of the first comparison signal VDIF1 is higher than the logic threshold voltage. For example, the logic block 230 may include a first inversion unit IV0 and a second inversion unit IV1. The first inversion unit IV0 may invert the first comparison signal VDIF1 based on the logic threshold voltage and generate an inverted logic signal. For example, the first inversion unit IV0 may generate an inverted logic signal having a high logic level when the voltage level of the first comparison signal VDIF1 is lower than the logic threshold voltage. Also for example, the first inversion unit IV0 may generate an inverted logic signal having a low logic level when the voltage level of the first comparison signal VDIF1 is higher than the logic threshold voltage. The second inversion unit IV1 may invert the inverted logic signal based on the logic threshold voltage and generate the second comparison signal VDIF2. For example, the second inversion unit IV1 may invert the inverted logic signal having the high logic level and generate the second comparison signal VDIF2 having the low logic level. Also, for example, the second inversion unit IV1 may invert the inverted logic signal having the low logic level and generate the second comparison signal VDIF2 having the high logic level.

The second driving block 240 may drive the core voltage VCORE terminal with the power source voltage VDD in response to the second comparison signal VDIF2. The second driving block 240 may be fully enabled while the voltage level of the first comparison signal VDIF1 is lower than the logic threshold voltage. The second driving block 240 may be fully disabled in response to the second comparison signal VDIF2 while the voltage level of the first comparison signal VDIF1 is higher than the logic threshold voltage. For example, the second driving block 240 may include a fourth PMOS transistor MXP3. The fourth PMOS transistor MXP3 may have a source coupled to the power source voltage VDD terminal, a drain coupled to the core voltage VCORE terminal and a gate receiving the second comparison signal VDIF2.

The feedback block 250 may divide the core voltage VCORE at a preset division ratio to generate the feedback voltage VFDB. For example, the feedback block 250 may include a fourth NMOS transistor MXN3 and a fifth NMOS transistor MXN4. The fourth NMOS transistor MXN3 may have a drain and a gate that are coupled to the core voltage VCORE terminal and a source coupled to a feedback voltage terminal FDB. The fifth NMOS transistor MXN4 may have a drain and a gate that are coupled to the feedback voltage terminal FDB and a source coupled to the ground voltage VSS terminal.

Figure 5:
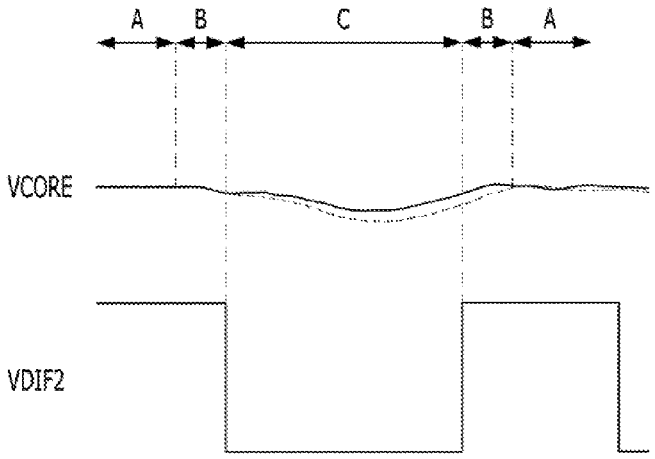
FIG. 5 is a timing diagram describing an operation of an internal voltage generator as the one shown in FIG. 3, according to an embodiment of the present invention.

FIG. 5 is a timing diagram for describing an operation of the internal voltage generator 200 shown in FIG. 3.

Referring to FIG. 5, the core voltage VCORE may have a stable section 'A' where the core voltage VCORE maintains a target level or increases above the target level. When a load current or a peak current occurs, the core voltage VCORE may have unstable sections 'B' and 'C' where the core voltage VCORE is lowered below the target level.

When the core voltage VCORE enters the unstable sections 'B' and 'C', the internal voltage generator 200 may operate in the following driving method.

The driving method of the internal voltage generator 200 may include dropping the core voltage VCORE generating the first comparison signal VDIF1 having an analog level whose voltage level may vary based on the core voltage VCORE and the second comparison signal VDIF2 having a logic level corresponding to the first comparison signal VDIF1 based on a logic threshold voltage, and compensating for the core voltage VCORE based on the first comparison signal VDIF1 or the core voltage VCORE based on the first comparison signal VDIF1 and the second comparison signal VDIF2, according to the voltage level of the first comparison signal VDIF1.

The lowering of the core voltage VCORE may cause the load current as described above. The core voltage VCORE may be lowered by a great deal as the load current occurs greatly. When the core voltage VCORE is lowered, the feedback voltage VFDB may also be lowered at the same time.

In an embodiment, the first and second comparison signals VDIF1, VDIF2 may be generated as follows. The comparison block 210 may compare the feedback voltage VFDB with the reference voltage VREFC and generate the first comparison signal VDIF1 corresponding to the comparison result. For example, when the feedback voltage VFDB is lower than the reference voltage VREFC, the comparison block 210 may generate the first comparison signal VDIF1 whose voltage level may be lowered corresponding to the voltage difference between the feedback voltage VFDB and the reference voltage VREFC. For example, when the core voltage VCORE is lowered below a target level, the feedback voltage VFDB may be lower than the reference voltage VREFC and thus, the voltage level of the first output terminal DRV may be lowered. Therefore, the voltage level of the first comparison signal VDIF1 may be lowered corresponding to the voltage level of the first output terminal DRV. The logic block 230 may generate the second comparison signal VDIF2 having a preset logic level based on the voltage level of the first comparison signal VDIF1. For example the logic block 230 may generate the second comparison signal VDIF2 having a high logic level when the voltage level of the first comparison signal VDIF1 is higher than the logic threshold voltage and the second comparison signal VDIF2 having a low logic level when the voltage level of the first comparison signal VDIF1 is lower than the logic threshold voltage.

Compensating of the core voltage VCORE may include the first driving block 220 driving the core voltage VCORE based on the first comparison signal VDIF1 during a first fluctuation section 'B', and the first driving block 220 and the second driving block 240 driving the core voltage VCORE based on the first comparison signal VDIF1 and the second comparison signal VDIF2 during a second fluctuation section 'C'. The first fluctuation section 'B' and the second fluctuation section 'C' may be included in the unstable sections 'B' and 'C'. The first fluctuation section 'B' may include the unstable section 'B' where the voltage level of the first comparison signal VDIF1 may be higher than the logic threshold voltage among the unstable sections 'B' and 'C'. The second fluctuation section 'C' may include the unstable section 'C' where the voltage level of the first comparison signal VDIF1 is lower than the logic threshold voltage among the unstable sections 'B' and 'C'. The first driving block 220 may be enabled and adaptively drive the core voltage VCORE terminal with the power source voltage VDD based on the voltage level of the first comparison signal VDIF1 during the first fluctuation section 'B'. On the other hand, the second driving block 240 may be turned off during the first fluctuation section 'B'. The first driving block 220 may be enabled and adaptively drive the core voltage VCORE terminal with the power source voltage VDD based on the voltage level of the first comparison signal VDIF1 during the second fluctuation section 'C'. The second driving block 240 may be fully enabled based on the second comparison signal VDIF2 and fully drive the core voltage VCORE terminal with the power source voltage VDD during the second fluctuation section 'C'.

Subsequently, when the core voltage VCORE is compensated, the internal voltage generator 200 may enter the first fluctuation section 'B' again. The logic block 230 may generate the second comparison signal VDIF2 having the high logic level, and the second driving block 240 may be fully turned off. The first driving block 220 may adaptively drive the core voltage VCORE based on the voltage level of the first comparison signal VDIF1. Further, when the core voltage VCORE reaches the target level, the first driving block 220 may be turned off. For example, the comparison block 210 may generate the first comparison signal VDIF1 whose voltage level may be lowered as the feedback voltage VFDB level is increased above the reference voltage VREFC level. For example, when the core voltage VCORE reaches the target level or increases above the target level, the feedback voltage VFDB may increase above the reference voltage VREFC and thus the voltage level of the first output terminal DRV may increase. Therefore, the voltage level of the first comparison signal VDIF1 may increase corresponding to the voltage level of the first output terminal DRV. Consequently, the first driving block 220 may be turned off in response to the first comparison signal VDIF1.

Hence, according to an embodiment of the invention, a fluctuation of the core voltage VCORE and current consumption may be reduced as the first driving block 220 and the second driving block 240 may be adapted based on the voltage level of the core voltage VCORE during the unstable sections 'B' and 'C'.

Figure 6:
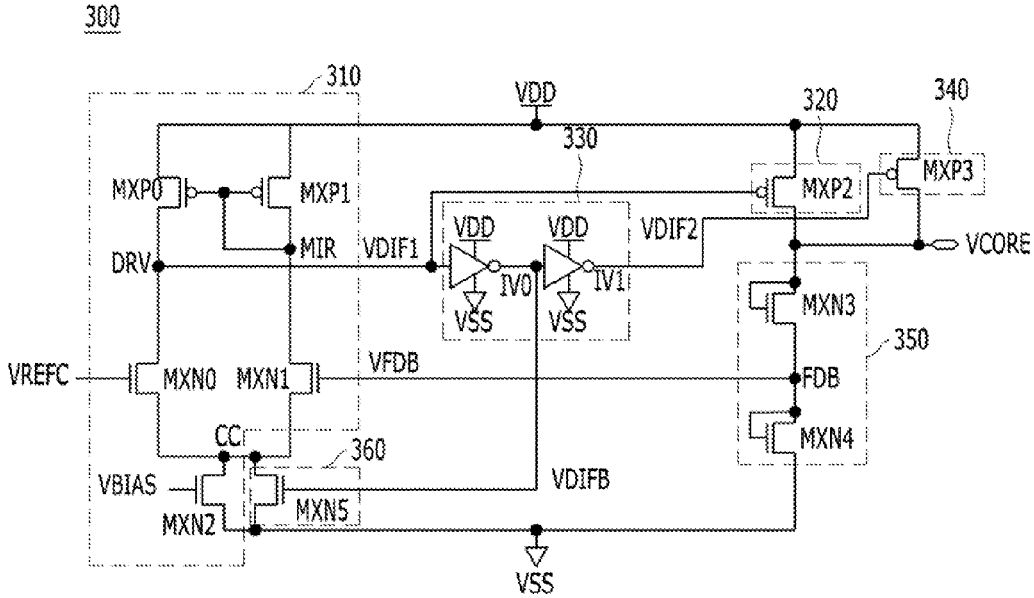
FIG. 6 is a circuit diagram illustrating an internal voltage generator, according to another embodiment of the present invention.

FIG. 6 is a circuit diagram illustrating an internal voltage generator according to another embodiment of the present invention.

Referring to FIG. 6, the internal voltage generator 300 may include a comparison block 310, a first driving block 320 a logic block 330, a second driving block 340, a feedback block 350, and an additional path providing block 360.

The comparison block 310 may compare a feedback voltage VFDB with a reference voltage VREFC and generate a first comparison signal VDIF1 corresponding to the comparison result. The first comparison signal VDIF1 may have an analog level that may vary corresponding to a voltage difference between the reference voltage VREFC and the feedback voltage VFDB.

For example, the comparison block 310 may be a differential amplifier including a first PMOS transistor MXP0, a second PMOS transistor MXP1, a first NMOS transistor MXN0, a second NMOS transistor MXN1 and a third NMOS transistor MXN2. The comparison block 310 may have the same configuration as the comparison block 210 shown in FIG. 4.

The first comparison signal VDIF1 may be outputted through the first output terminal DRV. The bias voltage VBIAS may be inputted as an enable signal for enabling the comparison block 310.

The first driving block 320 may generate a core voltage VCORE in response to the first comparison signal VDIF1 For example, the first driving block 320 may be enabled when the feedback voltage VFDB is lower than the reference voltage VREFC. For example, the first driving block 320 may be selectively enabled based on a voltage level of the first comparison sign& VDIF1 while the voltage level of the first comparison signal VDIF1 is higher than a logic threshold voltage of the logic block 330. The first driving block 320 may be continuously enabled based on the voltage level of the first comparison signal VDIF1 while the voltage level of the first comparison signal VDIF1 is lower than the logic threshold voltage. When the first driving block 320 is enabled, the first driving block 320 may adaptively drive the core voltage VCORE based on the voltage level of the first comparison signal VDIF1. The first driving block 320 may be disabled when the feedback voltage VFDB level is higher than the reference voltage VREFC level.

For example, the first driving block 320 may include a third PMOS transistor MXP2. That is the first driving block 320 may have the same configuration as the first driving block 220 shown in FIG. 4.

The logic block 330 may generate a second comparison signal VDIF2 in response to the first comparison signal VDIF1. The second comparison signal VDIF2 may have a logic level determined according to the voltage level of the first comparison signal VDIF1 based on a logic threshold voltage. The logic block 330 may generate the second comparison signal VDIF2 having a first logic level when the voltage level of the first comparison signal VDIF1 is lower than the logic threshold voltage. The logic block 330 may generate the second comparison signal VDIF2 having a second logic level when the voltage level of the first comparison signal VDIF1 is higher than the logic threshold voltage.

For example, the logic block 330 may include a first inversion unit IV0 and a second inversion unit IV1. That is, the logic block 330 may have the same configuration as the logic block 230 the first driving block 220 shown in FIG. 4.

The second driving block 340 may generate the core voltage VCORE in response to the second comparison signal VDIF2. For example, the second driving block 340 may be enabled when the voltage level of the first comparison signal VDIF1 is lower than the logic threshold voltage. For example, the second driving block 340 may be fully enabled while the voltage level of the first comparison signal VDIF1 is lower than the logic threshold voltage. When the second driving block 340 is enabled, the second driving block 340 may fully drive the core voltage VCORE in response to the second comparison signal VDIF2. The second driving block 340 may be fully disabled when the voltage level of the first comparison signal VDIF1 is higher than the logic threshold voltage.

For example, the second driving block 340 may include a fourth PMOS transistor MXP3. That is, the second driving block 340 may have the same configuration as the second driving block 240 shown in FIG. 4.

The feedback block 350 may generate the feedback voltage VFDB corresponding to the core voltage VCORE. For example, the feedback block 350 may divide the core voltage VCORE at a preset division ratio and generate the feedback voltage VFDB. For example, the feedback block 350 may include a fourth NMOS transistor MXN3 and a fifth NMOS transistor MXN4. That is, the feedback block 350 may have the same configuration as the feedback block 250 shown in FIG. 4.

The additional path providing block 360 may additionally provide the comparison block 310 with a sink current path (i.e., a current source) in response to the inverted logic signal VDIFB. Particularly, the additional path providing block 360 may be enabled together when the second driving block 340 is enabled. When the additional path providing block 360 is enabled, the additional path providing block 360 may additionally supply the sink current path between the common coupling terminal CC and the ground voltage VSS terminal. The additional path providing block 360 may be disabled together when the second driving block 340 is disabled. When the additional path providing block 360 is disabled, the additional path providing block 360 may not additionally supply the sink current path between the common coupling terminal CC and the ground voltage VSS terminal.

For example, the additional path providing block 360 may include a sixth NMOS transistor MXN5. The sixth NMOS transistor MXN5 may have a source coupled to the ground voltage VSS terminal, a drain coupled to the common coupling terminal CC and a gate receiving the inverted logic signal VDIFB.

Since an operation of the internal voltage generator 300 is similar to the operation of the internal voltage generator 200, a detailed description thereon is omitted. Meanwhile, when the second driving block 340 is enabled, the additional path providing block 360 may be enabled together. When the additional path providing block 360 is enabled, the additional path providing block 360 may additionally supply the sink current path between the common coupling terminal CC and the ground voltage VSS terminal. Consequently, an operation speed of the comparison block 310 may be improved and thus, a response time required for compensating for a fluctuation of the core voltage VCORE may be reduced.

Hence, according to an embodiment of the present invention, the fluctuation of the core voltage VCORE may be reduced to a greater level relatively to the internal voltage generator 200 because the response time required for compensating for the fluctuation of the core voltage VCORE is reduced.

According to embodiments of the present invention, a fluctuation of an internal voltage and current consumption may be reduced as the internal voltage is generated based on a comparison signal having an analog level and a comparison signal having a logic level.

Further, according to embodiments of the present invention, a response time required for compensating for the fluctuation of the internal voltage may be reduced as a sink current path is additionally provided based on a digital signal related to the comparison signal having the logic level.

While the present invention may have been described with respect to specific embodiments, the embodiments are not intended to be restrictive. Further, it is noted that the present invention may be achieved in various ways through substitution, change, and modification, by those skilled in the art without departing from the scope of the present invention as defined by the following claims.

What is claimed is:

1. An internal voltage generator, comprising:

a comparison block configured to compare an internal voltage that is fed back with a reference voltage and generate a first comparison signal having an analog level corresponding to a comparison result;

a first driving block configured to drive an output terminal of the internal voltage with a source voltage in response to the first comparison signal;

a logic block configured to generate a second comparison signal having a logic level corresponding to the first comparison signal;

a second driving block configured to drive the output terminal of the internal voltage with the source voltage based on the second comparison signal; and an additional path providing block configured to provide the comparison block with an additional current source, in addition to a default current source included in the comparison block and enabled based on a bias voltage, based on an inverted signal of the second comparison signal.

2. The internal voltage generator of claim 1, wherein the logic block generates the second comparison signal having a first logic level when a voltage level of the first comparison signal is lower than a logic threshold voltage.

3. The internal voltage generator of claim 2, wherein the logic block generates the second comparison signal having a second logic level when the voltage level of the first comparison signal is higher than the logic threshold voltage.

4. The internal voltage generator of claim 3, wherein the first driving block is selectively enabled based on the voltage level of the first comparison signal while the voltage level of the first comparison signal is higher than the logic threshold voltage and continuously enabled based on the voltage level of the first comparison signal while the voltage level of the first comparison signal is lower than the logic threshold voltage.

5. The internal voltage generator of claim 3, wherein the second driving block is disabled while the voltage level of the first comparison signal is higher than the logic threshold voltage and enabled while the voltage level of the first comparison signal is lower than the logic threshold voltage.

6. The internal voltage generator of claim 3, wherein the logic block includes:

a first inversion unit configured to invert the first comparison signal based on the logic threshold voltage and generate an inverted logic signal; and a second inversion unit configured to invert the inverted logic signal based on the logic threshold voltage and generate the second comparison signal.

7. The internal voltage generator of claim 6, wherein the inverted signal of the second comparison signal corresponds to the inverted logic signal.

* * * * *